US005820741A

United States Patent [19]

Bibber

[11] Patent Number: 5,820,741

[45] Date of Patent: Oct. 13, 1998

[54] PASSIFICATION OF ZINC SURFACES

[75] Inventor: John W. Bibber, Batavia, Ill.

[73] Assignee: Sanchem, Inc., Chicago, Ill.

[21] Appl. No.: 567,627

[22] Filed: Dec. 5, 1995

[51] Int. Cl.[6] ..... C25D 3/06

[52] U.S. Cl. ..... 205/287; 205/724

[58] Field of Search ..... 205/287, 288, 205/289, 724

[56] References Cited

U.S. PATENT DOCUMENTS

| | | | |
|---|---|---|---|
| 3,954,574 | 5/1976 | Gyllenspetz et al. | 205/287 |
| 4,169,022 | 9/1979 | Ward et al. | 204/56 R |
| 4,392,922 | 7/1983 | Tomaszewski | 205/287 |
| 4,439,285 | 3/1984 | Tomaszewski | 205/287 |
| 4,460,438 | 7/1984 | Tardy et al. | 205/287 |
| 4,477,315 | 10/1984 | Tomaszewski | 205/289 |
| 4,477,318 | 10/1984 | Tomaszewski | 205/287 |
| 5,196,109 | 3/1993 | Scott | 205/289 |

*Primary Examiner*—Arun S. Phasge
*Attorney, Agent, or Firm*—Laff, Whitesel, Conte & Saret, Ltd.; Robert F. I. Conte

[57] ABSTRACT

A trivalent chromium protective coating composition for zinc or a zinc plated article having an acid pH of about 3.0 to 4.0 and a process for coating the zinc or zinc plated article in which the article is contacted with the composition and trivalent chromium is deposited on the article by electrolysis and an article of zinc or zinc plate is coated with a protective trivalent chromium composition.

15 Claims, No Drawings

PASSIFICATION OF ZINC SURFACES

FIELD OF INVENTION

The invention relates to a zinc coating composition and a method of providing zinc with a protective coating. More particularly, the present invention provides a zinc coating composition having as its essential ingredient chromium in the trivalent state (chromium III), and a method of coating the zinc using a trivalent chromium composition having a pH of about 3.0 to about 4.0

BACKGROUND OF INVENTION

Untreated zinc metal quickly develops a white film of zinc oxide. The zinc oxide film on the metal causes many deleterious affects. For example, zinc oxide prevents paint from adhering to the metal. In addition, the oxide accelerates further corrosion.

Passification prevents the growth of zinc oxide (see British Patent No. 592,073; Wendorff, Z., Zolnierowicz, A.: Ochronaprzed Korozja, 13,1 (1970); Ostrander, G. W.: Plating, 38, 1033 (1951); and British Patent No. 594,699). Typical passification processes utilize a dichromate or chromate composition. The composition is applied to the metal via immersion or by electrochemical methods (see Fishlock, D. J.: *Product Finishing*, 12, 87 (1959)). A variety of pH's, immersion times and temperatures can be used. Increasing immersion times up to 300 seconds generally produces more effective coatings. Immersion times beyond 300 seconds typically do not produce more effective coatings. 200 hours is generally around the upper limit on salt spray protection (ASTM-117). See Biestek, T.: *Prace Instytutu Mechaniki Precyzyynej*, 19, 39 (1966). The process utilizes hexavalent chromium.

Reliance on hexavalent chromium has many drawbacks. Hexavalent chromium is extremely toxic and thus more costly to work with. For instance, hexavalent chromium requires special waste disposal. Applicant has developed a unique zinc coating composition which is superior, in part, because it does not have the toxicity and cost associated with hexavalent chromium. Applicant's novel zinc coating composition does not require hexavalent chromium. Applicant's novel zinc coating composition utilizes trivalent chromium as its essential ingredient.

SUMMARY OF INVENTION

The present invention concerns a method for coating zinc or zinc plated articles with a non-hexavalent chromium protecting coating comprising coating said zinc or zinc plated article with a hexavalent chromium free trivalent chromium composition having a pH of about 3.0 to about 4.0.

The invention also concerns a passified zinc or zinc plated article having coated thereon a trivalent chromium protective coating.

Accordingly, one aspect of the invention is directed toward providing a method of coating an article of zinc or zinc plated material with a protective coating. The process provides an electrolyte composition having an acid pH of about 3.0 to about 4.0 and as its essential ingredient, chromium in the trivalent state. The process contacts the article with the electrolyte composition and deposits trivalent chromium on the article by electrolysis.

Another aspect of the invention is directed at a trivalent chromium coating composition for coating zinc.

Still another aspect of the invention is directed at a manufacture of an article of zinc or zinc coated material having a trivalent chromium protective coating thereon.

DETAILED DESCRIPTION

The present invention can be further understood with reference to the following description and examples.

The present invention eliminates the need for hexavalent chromium compositions which, due to their extreme toxicity, are being forced out of the work place environment. In addition, the invention provides substantially the same high level of corrosion resistance as that given by hexavalent chromium compositions while at the same time being considerably less toxic. Very little toxic waste is produced and thus very little needs to be disposed of.

Accordingly, this invention provides a protective coating for zinc and zinc plated surfaces which has as its essential ingredient trivalent chromium (Chromium (III)). The process uses electrolysis of various trivalent chromium solutions to deposit a thin film of elemental chromium and various reduced chromic oxides or hydroxides. The concentration of chromium (III) in solution and the amount of electrical current applied determines the amounts of chromium and/or chromic oxide, $Cr_2O_3$, deposited and the time needed to deposit them. A concentration of chromium (III) below 0.5 grams/liter is not economically feasible to deposit because the corrosion resistant film has insufficient thickness produced in the time generally desired for an economical production run. The upper concentration limit is the saturation point of the chromium (III) salt in question.

The most suitable pH range is between 3.0 and 4.0. Zinc dissolves in strong acid or basic solutions. A pH above 4.0 results in an unstable solution. With a pH below 3.0, the chromium oxides and/or hydroxides are not in a proper ratio to provide sufficient corrosion resistance for zinc. The most preferred range is between 3.25 and 3.4. The pH, when necessary, is adjusted and maintained adding an appropriate buffer.

In example 9, infra, a pH of 2.8 shows the undesirable white oxide formation after only 12 hours of exposure to the salt spray.

The voltage should be above the reduction potential of chromium (III). In water this is about 0.74 volts relative to the standard hydrogen electrode.

Some chromium (III) salts have anions which inhibit production of a passive film on zinc surfaces. For this reason the preferred chromium (III) salts are the chloride and the sulfate with the sulfate being the most preferred because the chloride may release chlorine gas at the anode of the electrolytic cell and cause environmental problems. In addition, the sulfate is generally less expensive. Potassium chromium sulfate is the most preferred sulfate as simple chromium sulfate is not as conductive and is less soluble. Various other materials may be added to the bath to increase conductivity, prevent formation of hexavalent chromium and to clean or wet out the surface of the zinc as long as these materials do not inhibit formation or destroy the protective trivalent chromium coating.

The following examples illustrate the invention in detail. In the examples, a zinc plated steel surface or pure zinc sheet was cleaned of oils and/or loose soil with a nonionic detergent. Then the cleaned zinc plated steel or zinc sheet was made the cathode of an electrolytic cell of 12 volts and 10 amps for 30 seconds in a dilute sodium carbonate solution (2.5 grams per liter) to obtain a clean reactive surface. The clean surface was then rinsed in D.I. water and treated as indicted immediately. The zinc plated steel and zinc sheet of the examples were 3 by 5 inch metal strips. The applied voltage was 12 volts and the applied amperage was 10 or 2 amps. Exposure time was 60 seconds.

Example 3 illustrates that using a concentration of less than 5.0 g/l, i.e., 4.0 g/l for the same voltage, pH and immersion time as Example 2 was inadequate to provide a protecting coating on the zinc surface.

Example 9 illustrates that using a pH of less than 3 (i.e., 2.8) is not acceptable.

Examples 10, 11 and 13 illustrates that only approximately 100 hours of protection was obtained by using a pH close to the upper or lower limit of my pH range (i.e, 3, 3.8 and 4.0).

Example 14 illustrates that chromiumum citrate is not an acceptable substitute for potassium chromimum sulfate. Citric acid is known to form a protective film over zinc, an thus prevent formation of chromium oxides.

EXAMPLE 1

A solution of 5.0 g/l potassium chromium sulfate twelve hydrate ($KCr(SO_4)_2.12H_2O$) which contains about 0.52 g/l of chromium was used as the electrolite for an electrolytic cell in which zinc plated steel was the cathode and stainless steel the anode. Twelve volts and ten amps were applied to the solution for 60 seconds at 70° F. and a pH of 3.3. The zinc plate was rinsed in D.I. water, dried, and placed in a neutral salt spray at 95° F. according to ASTM B-117. After 200 hours of exposure there were no signs of white oxide on the surface of the metal.

EXAMPLE 2

A solution of 5.0 g/l potassium chromium sulfate twelve hydrate ($KCr(SO_4)_2.12H_2O$) which contains about 0.52 g/l of chromium was used as the electrolite for an electrolytic cell in which the zinc sheet was the cathode and stainless steel the anode. Twelve volts and ten amps were applied to the solution for 60 seconds at 70° F. and a pH of 3.3. The zinc sheet was rinsed in D.I. water, dried, and placed in a neutral salt spray at 95° F. according to ASTM B-117. After 200 hours of exposure there were no signs of white oxide on the surface of the metal.

EXAMPLE 3

A solution of 4.0 g/l potassium chromium sulfate twelve hydrate ($KCr(SO_4)_2.12H_2O$) which contains about 0.42 g/l of chromium was used as the electrolite for an electrolytic cell in which zinc plated steel was the cathode and stainless steel the anode. Twelve volts and ten amps were applied to the solution for 60 seconds at 70° F. and a pH of 3.3. The zinc plate was rinsed in D.I. water, dried, and placed in a neutral salt spray at 95° F. according to ASTM B-117. After 4 hours of exposure there were signs of white oxide on the surface of the metal.

EXAMPLE 4

A saturated solution of potassium chromium sulfate twelve hydrate ($KCr(SO_4)_2.12H_2O$) was used as the electrolite for an electrolytic cell in which zinc plated steel was the cathode and stainless steel the anode. Twelve volts and ten amps were applied to the solution for 60 seconds at 70° F. and a pH of 3.3. The zinc plate was rinsed in D.I. water, dried, and placed in a neutral salt spray at 95° F. according to ASTM B-117. After 200 hours of exposure there were no signs of white oxide on the surface of the metal.

EXAMPLE 5

A solution of 5.0 g/l potassium chromium sulfate twelve hydrate ($KCr(SO_4)_2.12H_2O$) which contains about 0.52 g/l of chromium was used as the electrolite for an electrolytic cell in which zinc plated steel was the cathode and stainless steel the anode. Twelve volts and ten amps were applied to the solution for 60 seconds at 200° F. and a pH of 3.3. The zinc plate was rinsed in D.I. water, dried, and placed in a neutral salt spray at 95° F. according to ASTM B-117. After 200 hours of exposure there were no signs of white oxide on the surface of the metal.

EXAMPLE 6

A solution of 5.0 g/l potassium chromium sulfate twelve hydrate ($KCr(SO_4)_2.12H_2O$) which contains about 0.52 g/l of chromium was used as the electrolite for an electrolytic cell in which zinc plated steel was the cathode and stainless steel the anode. Twelve volts and ten amps were applied to the solution for 60 seconds at 30° F. and a pH of 3.3. The zinc plate was rinsed in D.I. water, dried, and placed in a neutral salt spray at 95° F. according to ASTM B-117. After 200 hours of exposure there were no signs of white oxide on the surface of the metal.

EXAMPLE 7

A solution of 5.0 g/l chromium (III) chloride hexahydrate was used as the electrolite for an electrolytic cell in which zinc plated steel was the cathode and stainless steel the anode. Twelve volts and ten amps were applied to the solution for 60 seconds at 70° F. and a pH of 3.3. The zinc plate was rinsed in D.I. water, dried, and placed in a neutral salt spray at 95° F. according to ASTM B-117. After 200 hours of exposure there were no signs of white oxide on the surface of the metal.

EXAMPLE 8

A solution of 5.0 g/l chromium (III) sulfate hydrate was used as the electrolite for an electrolytic cell in which zinc plated steel was the cathode and stainless steel the anode. Twelve volts and ten amps were applied to the solution for 60 seconds at 70° F. and a pH of 3.3. The zinc plate was rinsed in D.I. water, dried, and placed in a neutral salt spray at 95° F. according to ASTM B-117. After 200 hours of exposure there were no signs of white oxide on the surface of the metal.

EXAMPLE 9

A solution of 5.0 g/l potassium chromium sulfate twelve hydrate ($KCr(SO_4)_2.12H_2O$) which contains about 0.52 g/l of chromium was used as the electrolite for an electrolytic cell in which zinc plated steel was the cathode and stainless steel the anode. Twelve volts and ten amps were applied to the solution for 60 seconds at 70° F. and a pH of 2.8. The zinc plate was rinsed in D.I. water, dried, and placed in a neutral salt spray at 95° F. according to ASTM B-117. After 12 hours of exposure white oxides formed on the zinc surface.

EXAMPLE 10

A solution of 5.0 g/l potassium chromium sulfate twelve hydrate ($KCr(SO_4)_2.12H_2O$) which contains about 0.52 g/l of chromium was used as the electrolite for an electrolytic cell in which zinc plated steel was the cathode and stainless steel the anode. Twelve volts and ten amps were applied to the solution for 60 seconds at 70° F. and a pH of 3.0. The zinc plate was rinsed in D.I. water, dried, and placed in a neutral salt spray at 95° F. according to ASTM B-117. After 125 hours of exposure signs of corrosion showed up on on the metal surfaces.

EXAMPLE 11

A solution of 5.0 g/l potassium chromium sulfate twelve hydrate ($KCr(SO_4)_2.12H_2O$) which contains about 0.52 g/l of chromium was used as the electrolite for an electrolytic cell in which zinc plated steel was the cathode and stainless steel the anode. Twelve volts and ten amps were applied to the solution for 60 seconds at 70° F. and a pH of 3.8. The zinc plate was rinsed in D.I. water, dried, and placed in a neutral salt spray at 95° F. according to ASTM B-117. After 100 hours of exposure signs of corrosion showed up on on the metal surfaces.

EXAMPLE 12

A solution of 5.0 g/l potassium chromium sulfate twelve hydrate ($KCr(SO_4)_2.12H_2O$) which contains about 0.52 g/l of chromium was used as the electrolite for an electrolytic cell in which zinc plated steel was the cathode and stainless steel the anode. Twelve volts and two amps were applied to the solution for 60 seconds at 70° F. and a pH of 3.4. The zinc plate was rinsed in D.I. water, dried, and placed in a neutral salt spray at 95° F. according to ASTM B-117. After 200 hours of exposure there were no signs of corrosion showed up on on the metal surfaces.

EXAMPLE 13

A solution of 5.0 g/l potassium chromium sulfate twelve hydrate ($KCr(SO_4)_2.12H_2O$) which contains about 0.52 g/l of chromium was used as the electrolite for an electrolytic cell in which zinc plated steel was the cathode and stainless steel the anode. Twelve volts and ten amps were applied to the solution for 60 seconds at 70° F. and a pH of 4.0. The zinc plate was rinsed in D.I. water, dried, and placed in a neutral salt spray at 95° F. according to ASTM B-117. After 100 hours of exposure signs of corrosion showed up on on the metal surfaces.

EXAMPLE 14

A solution of 5.0 g/l chromium citrate was used as the electrolite for an electrolytic cell in which zinc plated steel was the cathode and stainless steel the anode. Twelve volts and ten amps were applied to the solution for 60 seconds at 700F and a pH of 3.3. The zinc plate was rinsed in D.I. water, dried, and placed in a neutral salt spray at 95° F. according to ASTM B-117. After 4 hours of exposure there were signs of corrosion on the metal. Citric acid is known to form a protective film over zinc.

EXAMPLE 15

A solution of 5.0 g/l potassium chromium sulfate twelve hydrate ($KCr(SO_4)_2.12H_2O$) to which 100 mg/l of sulfite ($SO_3^{-2}$) was added to prevent the formatin of hexavalent chromium, was used as the electrolite for an electrolytic cell in which zinc plated steel was the cathode and stainless steel the anode. Twelve volts and ten amps were applied to the solution for 60 seconds at 70° F. and a pH of 3.3. The zinc plate was rinsed in D.I. water, dried, and placed in a neutral salt spray at 95° F. according to ASTM B-117. After 200 hours of exposure there were no signs of corrosion.

EXAMPLE 16

A solution of 5.0 g/l potassium chromium sulfate twelve hydrate ($KCr(SO_4)_2.12H_2O$) to which 500 mg/l of potassium dichromate was added, was used as the electrolite for an electrolytic cell in which zinc plated steel was the cathode and stainless steel the anode. Twelve volts and ten amps were applied to the solution for 60 seconds at 70° F. and a pH of 3.3. The zinc plate was rinsed in D.I. water, dried, and placed in a neutral salt spray at 95° F. according to ASTM B-117. After 200 hours of exposure there were no signs of corrosion.

EXAMPLE 17

A solution of 5.0 g/l potassium chromium sulfate twelve hydrate ($KCr(SO_4)_2.12H_2O$), to which 500 mg/l of a non-ionic wetting agent was added, was used as the electrolite for an electrolytic cell in which zinc plated steel was the cathode and stainless steel the anode. Twelve volts and ten amps were applied to the solution for 60 seconds at 70° F. and a pH of 3.3. The zinc plate was rinsed in D.I. water, dried, and placed in a neutral salt spray at 95° F. according to ASTM B-117. After 200 hours of exposure there were no signs of corrosion.

EXAMPLE 18

A solution of 5.0 g/l potassium chromium sulfate twelve hydrate ($KCr(SO_4)_2.12H_2O$), to which 500 mg/l of a non-ionic wetting agent was added, was used as the electrolite for an electrolytic cell in which zinc plated steel was the cathode and stainless steel the anode. Twelve volts and ten amps were applied to the solution for 60 seconds at 70° F. and a pH of 3.3 was maintained by use of a Potassium hydrogen phthalate sulfuric acid buffer system. The zinc plate was rinsed in D.I. water, dried, and placed in a neutral salt spray at 95° F. according to ASTM B-117. After 200 hours of exposure there were no signs of corrosion.

What is claimed is:

1. A method for coating zinc or zinc plated articles with a non-hexavalent chromium oxide protective coating comprising electrolytically coating said zinc or zinc plated article with a hexavalent chromium free trivalent chromium oxide composition having a pH of about 3.0 to about 4.0, and said composition being free of chromium complexing agent, and depositing trivalent chromium oxide on said zinc or zinc plated article.

2. The method of claim 1 wherein said trivalent chromium composition comprises trivalent chromium compounds selected from the group consisting of potassium chromium sulfate, chromium chloride, chromium sulfate and the hydrates thereof.

3. The method of claim 2 wherein the pH range is about 3.25 to about 3.4.

4. The method of claim 3 wherein said zinc or zinc plated article is electrolytically coated with the trivalent chromium composition by exposing for about 60 to about 300 seconds the zinc or zinc plated article to the trivalent chromium composition having a trivalent chromium concentration sufficient to provide a trivalent chromium oxide protecting coating.

5. The method of claim 4 wherein the zinc or zinc plated article is exposed to the trivalent chromium composition for about 60 seconds.

6. A process for coating zinc or zinc plated article with a protective coating comprising:

providing an electrolyte solution having as an essential ingredient trivalent chromium which is maintained above 0.05 grams per liter of solution and having an acid pH of about 3.0 to about 4.0;

contacting said article with said electrolyte solution;

depositing trivalent chromium oxide on said article by electrolysis, said electrolysis utilizing a voltage above the reduction potential of chromium, and, said article having corrosion protection in a neutral salt spray at 95° for at least 100 hours.

7. The process as claimed in claim 6 wherein said chromium is a chromium salt selected from the group consisting of potassium chromium sulfate, a chromium sulfate, a chromium chloride, and hydrates thereof.

8. The process of claim 6 wherein the zinc or zinc plated article is cleaned and then made the cathode of an electrolytic cell having a dilute sodium carbonate solution to provide a clean reactive surface zinc or zinc plated article, rinsing the clean reactive surface zinc or zinc plated article, placing the rinsed clean reactive surface zinc or zinc plated article as a cathode in the electrolytic trivalent chromium electrolyte, applying electrical current to the cathode for about 60 seconds to provide a trivalent chromium oxide protective coated zinc or zinc plated article.

9. A passified zinc or zinc plated article having coated thereon a trivalent chromium oxide protective coating being able to provide corrosion protection in a neutral salt spray at 95° F. for more than 100 hours.

10. The article of claim 9 wherein said coating is hexavalent chromium free.

11. A protectively coated zinc or zinc plated article comprising:

an article of zinc or zinc plated material having an electrolytic coating of trivalent chromium oxide and said article having corrosion protection for at least 100 hours in a neutral salt spray at 95° F.

12. A protective trivalent chromium coating composition for coating zinc or a zinc plated article comprising an acid pH of between about 3.0 to 4.0 having as an essential ingredient a trivalent chromium compound selected from the group consisting of potassium chromium sulfate, chromium sulfate, chromium chloride, and hydrates thereof and said composition being free of chromium complexing agents.

13. The composition as claimed in claim 12 wherein the pH is between about 3.25 and 3.4.

14. The composition claimed in claim 13 wherein the concentration of trivalent chromium is maintained above 0.05 grams per liter of solution.

15. The composition as claimed in claim 14 having sulfite or potassium dichromate added to said solution.

* * * * *

UNITED STATES PATENT AND TRADEMARK OFFICE

CERTIFICATE OF CORRECTION

PATENT NO. : 5,820,741
DATED : October 13, 1998
INVENTOR(S) : John W. Bibber

It is certified that error appears in the above-indentified patent and that said Letters Patent is hereby corrected as shown below:

Column 5, Line 44, delete "700F" and insert --70°F--

Signed and Sealed this

Sixteenth Day of March, 1999

*Attest:*

Q. TODD DICKINSON

*Attesting Officer*

*Acting Commissioner of Patents and Trademarks*